US011802745B2

(12) United States Patent
Eggert

(10) Patent No.: US 11,802,745 B2
(45) Date of Patent: Oct. 31, 2023

(54) BREECH AND WEAPON SYSTEM WITH THE BREECHBLOCK

(71) Applicant: RHEINMETALL WAFFE MUNITION GMBH, Suedheide (DE)

(72) Inventor: Klaus-Peter Eggert, Zimmern (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 53 days.

(21) Appl. No.: 17/582,790

(22) Filed: Jan. 24, 2022

(65) Prior Publication Data

US 2022/0146223 A1 May 12, 2022

Related U.S. Application Data

(63) Continuation of application No. PCT/EP2020/069280, filed on Jul. 8, 2020.

(30) Foreign Application Priority Data

Jul. 25, 2019 (DE) ..... 10 2019 120 184.5

(51) Int. Cl.
*F41A 7/08* (2006.01)
*F41A 3/26* (2006.01)
(Continued)

(52) U.S. Cl.
CPC ..... *F41A 7/08* (2013.01); *F41A 3/26* (2013.01); *F41A 5/32* (2013.01); *F41A 15/14* (2013.01)

(58) Field of Classification Search
CPC ..... F41A 7/08; F41A 3/26; F41A 5/32; F41A 15/14
(Continued)

(56) References Cited

U.S. PATENT DOCUMENTS 4,807,513 A * 2/1989 Post ..... F41A 3/50 89/187.01
4,841,835 A 6/1989 Bohler et al.
(Continued)

FOREIGN PATENT DOCUMENTS

DE 139766 C 3/1903
DE 3712905 A1 11/1988
(Continued)

OTHER PUBLICATIONS

International Search Report dated Oct. 27, 2020 in corresponding application PCT/EP2020/069280.

*Primary Examiner* — Michael D David
(74) *Attorney, Agent, or Firm* — Muncy, Geissler, Olds & Lowe, P.C.

(57) ABSTRACT

In order to ensure that forces acting on a breech drive when unlocking the breech and pulling out a cartridge case are reduced or even eliminated, a breech of a weapon system is proposed which is formed at least by one breech carrier and one breech head and the breech carrier supports the breech head. The breech carrier and the breech head can be mechanically separated from one another. This separability is achieved in that a control case which has at least one control cam is inserted in the breech carrier. In addition, the breech head has a control bolt which engages in the control cam of the control case and can be guided in it. This measure ensures that the forces acting upon the recoil of the weapon cannot act on the breech drive.

10 Claims, 5 Drawing Sheets

(51) Int. Cl.
*F41A 5/32* (2006.01)
*F41A 15/14* (2006.01)

(58) Field of Classification Search
USPC ..... 89/11, 12, 180, 181, 187.01
See application file for complete search history.

(56) References Cited

U.S. PATENT DOCUMENTS

| | | | | |
|---|---|---|---|---|
| 5,134,922 | A * | 8/1992 | Menges | F41A 7/08 89/11 |
| 5,920,028 | A | 7/1999 | Guhring et al. | |
| 7,721,639 | B2 | 5/2010 | Woessner | |
| 8,413,565 | B2 * | 4/2013 | Herrmann | F41A 9/50 42/2 |
| 8,479,633 | B2 * | 7/2013 | Herrmann | F41A 7/08 89/9 |
| 8,616,112 | B2 | 12/2013 | Herrmann et al. | |
| 8,677,883 | B2 | 3/2014 | Woessner et al. | |
| 10,591,241 | B2 | 3/2020 | Schneider | |
| 10,739,102 | B2 | 8/2020 | Schneider | |
| 10,746,493 | B1 * | 8/2020 | Steimke | F41A 9/29 |
| 11,022,385 | B2 * | 6/2021 | Steimke | F41A 17/64 |
| 2005/0011346 | A1 * | 1/2005 | Wolff | F41F 1/10 89/12 |
| 2022/0146220 | A1 * | 5/2022 | Mueller | F41A 7/08 |
| 2022/0146222 | A1 * | 5/2022 | Eggert | F41A 5/32 |
| 2022/0290935 | A1 * | 9/2022 | Eggert | F41A 7/08 |

FOREIGN PATENT DOCUMENTS

| | | | |
|---|---|---|---|
| DE | 19616397 | A1 | 11/1997 |
| DE | 102006022622 | A1 | 11/2007 |
| DE | 102008060217 | A1 | 6/2010 |
| DE | 102009011939 | B4 | 9/2010 |
| DE | 102009058551 | B4 | 9/2011 |
| DE | 102010009427 | B4 | 9/2011 |
| DE | 102014108469 | A1 | 12/2015 |
| DE | 102015121771 | A1 | 1/2017 |
| EP | 2018509 | B1 | 1/2009 |

* cited by examiner

BREECH AND WEAPON SYSTEM WITH THE BREECHBLOCK

This nonprovisional application is a continuation of International Application No. PCT/EP2020/069280, which was filed on Jul. 8, 2020, and which claims priority to German Patent Application No. 10 2019 120 184.5, which was filed in Germany on Jul. 25, 2019, and which are both herein incorporated by reference.

BACKGROUND OF THE INVENTION

Field of the Invention

The present invention relates to a possibility for unlocking a breech of an in particular externally powered automatic weapon or automatic cannon. The invention also relates to a possibility of subsequently withdrawing a cartridge case from a weapon barrel of the automatic weapon or automatic cannon.

Description of the Background Art

Internally or externally powered automatic cannons are known. In weapon systems of this type, a cartridge is presented to a breech and, with the aid of the breech's transport, i.e. the breech movement, the cartridge is brought into a weapon barrel or into a chamber of the weapon barrel. The breech movement includes downtimes during which the breech must not be moved. The locking between the breech and the weapon barrel takes place via known breech systems, such as block breech, wedge breech, rotary lug breech, etc.

A rotary lug breech and a weapon with a rotary lug breech are known from DE 10 2010 009 427 B4, which corresponds to US 2013/074390. The rotary lug breech has a breech carrier and a breech head mounted therein with a plurality of locking lugs. The rotary lug breech is designed in such a way that the unlocking, in which the cartridge case is released from a cartridge chamber of the weapon barrel, is not controlled exclusively via the relative movement between the breech head and breech carrier. For this purpose, a control cam section is formed in the locking piece, which cooperates with a correspondingly designed control section in the breech head. When unlocking, the rotary movement of the breech head is converted into a screwing movement relative to the locking piece. This screwing movement leads the breech head screwing out of the locking head.

The same control cams and control cam sections also lock the breech.

DE 10 2009 058 551 B4 discloses a further rotary breech. A rotary breech cylinder is held in the unlocked position on the breech carrier by a tongue and groove-like toothing of a link. A guide shell of the breech carrier can be reduced to such an extent that it only secures the rotary breech cylinder against tipping out of the functional axis.

A breech system for an externally and/or internally powered weapon with a block breech can be found in DE 10 2009 011 939 B4. When the returning mass of the weapon returns, the block breech for unlocking is controlled via control cams on the breech carrier and when the weapon returns, it is activated again for locking.

From EP 2 018 509 B1 a function control in particular for the linear feeding of ammunition into a weapon barrel is known. The externally powered weapon comprises a locking ring with lugs, which is preferably located on the weapon barrel, overlapping it, as well as lugs on a breech head.

When the breech head rests against the weapon barrel, the protruding locking ring is rotated, whereby the lugs of the locking ring are brought behind the lugs of the breech head and the breech is locked. The locking ring is rotated by a bolt guided in a control cam. It is unlocked by reversing the movement of the bolt in the control cam. The downtimes necessary for the weapon are implemented here via the control link and the drive link that interact with one another.

DE 196 16 397 A1, which corresponds to U.S. Pat. No. 5,920,028, discloses a self-loading handgun with an in particular non-rotatable breech carrier that can be moved in a straight line in the longitudinal direction of the weapon and a breech head rotatably mounted with its rear part in the breech carrier about a longitudinal direction for locking and unlocking. The breech head has on its rear part a control bolt which extends transversely to the longitudinal direction and which engages in a control link which extends obliquely to the longitudinal direction and is delimited by a first and a second side flank. In the locked state, the breech carrier is in its foremost position and the control bolt rests against the rear end of the control link. When firing, the breech carrier is moved and the breech head is rotated by the control bolt and the link in the breech carrier. The breech head is unlocked. When the control bolt strikes against the front end, the unlocking rotary movement of the breech head is completed during the weapon function. The breech head is taken back by the breech carrier through the engagement of the control bolt in the front end of the control link for the further weapon function.

U.S. Pat. No. 7,721,639 B2 discloses a locked machine gun. The breech has a breech head and a breech carrier. The breech carrier is designed to move in a straight line along the central axis. The breech head follows this movement in the weapon function, but performs a rotation around the central axis in the last phase of the forward movement. The breech head has a pin or sliding block, which is introduced into the locking head perpendicular to the central axis and penetrates a link. When firing, the breech carrier returns without first rotating the breech head.

During the return of the weapon, especially in the case of externally powered weapons, there may be a mechanical or functional separation of the drive (breech drive) and the breech. The breech is then separated from the weapon or breech drive during its downtimes and when the shot is fired, i.e. in the locked state, while the drive can continue to run. See, for example, DE 10 2015 121 771 A1, which corresponds to US 2018/0231344, which is incorporated herein by reference, and see DE 10 2008 060 217 A1, which corresponds to US 2012/0132062, which is incorporated herein by reference. For the actual weapon function, the drive is then mechanically connected to the breech, which is transported by the drive from the firing position to a loading position and back.

Such systems, in particular externally powered systems, and here in particular chain drives, however, have the problem that when the breech is unlocked and the empty cartridge case is pulled out, large forces act on the drive, e.g. a chain, and the pull-out forces must be applied by the drive (breech drive) or the chain.

SUMMARY OF THE INVENTION

It is therefore an object of the present invention to avoid the above problems.

The invention is based on the idea of minimising the forces acting on the breech drive when unlocking the breech and when pulling out a cartridge case.

According to an exemplary embodiment of the invention, these tasks of the breech drive are transferred to the breech and the weapon barrel. The breech and weapon barrel handle the unlocking and pulling out of the cartridge case themselves, independently of the breech drive. This reduces or even eliminates the forces that otherwise act on the breech drive, in particular in the case of an external drive (e.g. chain), when unlocking the breech and pulling out the cartridge case.

In implementing the idea, the recoil of a weapon (weapon recoiling) after the shot is used to unlock the breech of the weapon barrel and pull out the cartridge case, i.e. using the recoil and thus the returning masses of the weapon, the unlocking and pulling out of the cartridge case are realised.

As is known, a recoil is initiated when a shot is fired, wherein the returning masses of the weapon, usually the weapon barrel and the breech, are accelerated against the direction of the shot. This behaviour is also referred to as the "weapon return". At the end of the return, part of the recoil energy is stored in the return springs of a return device or the like. With this energy, the returning masses are moved forwards again, and they are in advance. Taking advantage of this fact, a new approach is created to circumvent deficiencies and problems, in particular of an external drive.

In the present case, it is now provided that the unlocking of the breech and the pulling out of the cartridge case are carried out during the forward movement of the returning mass which follows the return. According to the invention, the unlocking of the breech and the at least rudimentary pulling out of the cartridge case take place in the forward movement of the returning masses.

A machine gun with shot control is known from DE 37 12 905 A1, which is incorporated herein by reference. The breech includes a breech upper part and a slide, which are each arranged separately in the weapon housing so that they can be longitudinally displaced and can be positively coupled to one another via connecting means. In the event of a malfunction of a cartridge, the uncoupled breech upper part remains in the locking position, while all other weapon functions or movements are not slowed down, but continue to run and the slide is taken along by the drive without the breech upper part. A gas pressure-controlled decoupling of the breech upper part from the slide is provided.

The present breech comprises at least one breech carrier and one breech head supported by the latter. A firing pin can preferably be integrated in the breech head. According to the invention, the breech head and breech carrier are mechanically separated during weapon return. At the time of and during the return of the returning masses, there is therefore no fixed mechanical connection between the breech head and the breech carrier. The breech head is detached from the breech carrier and can move in relation to the breech carrier against the firing direction as well as in the firing direction.

As a rule, the weapon barrel has a chamber case which is used to lock the breech or breech head to the weapon barrel. The locking is effected by the chamber case, which in practice is connected to the weapon barrel and, if necessary, to a recoil suppressor.

When the shot has taken place and the recoil has been initiated, according to the invention, the breech head and the weapon barrel locked with the breech head return as returning masses of the weapon system. In the phase of this backward movement, the breech head is mechanically separated from the breech carrier. When the forward movement of the returning masses is initiated, the breech head is first unlocked from the weapon barrel or the chamber case and the cartridge case, which is hooked on the breech head, is pulled out of the weapon barrel via the further forward movement of the weapon barrel. In other words, only when the returning masses advance, to unlock the breech and pull out the cartridge case, is a firm mechanical connection established between the breech head and the breech carrier in the firing direction.

For the actual weapon function, the breech carrier and breech head are mechanically connected to one another. The breech carrier can thus be taken along with the breech head as part of the actual weapon function until the case ejection and the loading position are reached.

An external drive can be provided as the breech drive. This transfers the breech to a loading position and vice versa to a firing position. In these positions, the breech is in the weapon system or in the weapon.

A possible integration of the breech and the breech drive in a weapon system is shown in the parallel application of the applicant, to which reference is hereby made. In the present case, the breech drive can also be accommodated in a housing, which can be a component of a weapon housing. A guide or round rod is preferably integrated over the entire length of the housing. These engage in longitudinal bores in the breech carrier. The guide is used to support and stabilise the transport of the breech within the actual weapon function.

A control case with a control cam can be used in the breech carrier of the breech according to the invention for the practical implementation of the idea. The breech head can have a bolt which can engage and be guided in this control cam. The control case holds the breech head via the bolt. A slide enables the mechanical connection between the breech head and the breech carrier to be released when the returning masses move backwards.

When the returning masses advance, to unlock the breech and pull out the cartridge case, a firm mechanical connection is established between the control case and the breech carrier in the firing direction. The breech head is caught by the control case during the forward movement of the returning masses, whereby a mechanical connection between the breech head and the breech carrier can be established. This can be achieved by blocking the control case and/or blocking the ability to rotate the breech head.

The control case is provided with a detent. This detent is preferably attached to the side of the control case and, for example, in the form of a toothed rack. A latching slide attached on the breech carrier side engages this detent. The latching slide has no effect when the weapon is returned because it is controlled. When the returning masses advance, the latching slide blocks the control case and catches the breech head.

The breech head rushes forward in the control cam of the control case and rotates within it. As a result, the locking between the breech head and the weapon barrel or the chamber case is cancelled. The breech head is held in place by the control cam of the control case, which is caught.

The weapon barrel rushes further forward in the firing direction, so that a cartridge case hanging on the breech head is at least partially pulled out from the weapon barrel.

When the breech is transported back as part of the actual weapon function, the latching connection between the control case and the breech carrier is cancelled. The breech head can be pushed back into a loading and feeding function together with the firing pin. In this weapon function, the control case is held in its front end position by a (blocking) slide.

The firing pin is preferably not cocked until the breech is locked in the actual weapon function.

In the present case, a breech for a weapon system is proposed, wherein the breech is formed by at least one breech carrier and one breech head, and the breech carrier supports the breech head. In order to ensure that the forces acting on the breech drive when unlocking the breech and pulling out a cartridge case are reduced or even eliminated, it is provided that the breech carrier and the breech head can be mechanically separated from each other when the returning masses return. This measure ensures that the forces acting upon the recoil of the weapon do not act on the breech drive. At the end of the advance of the returning masses, the breech carrier and breech head can be mechanically connected to one another.

If the recoil should fail due to a failure to fire, the device does not engage further in the actual weapon function.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
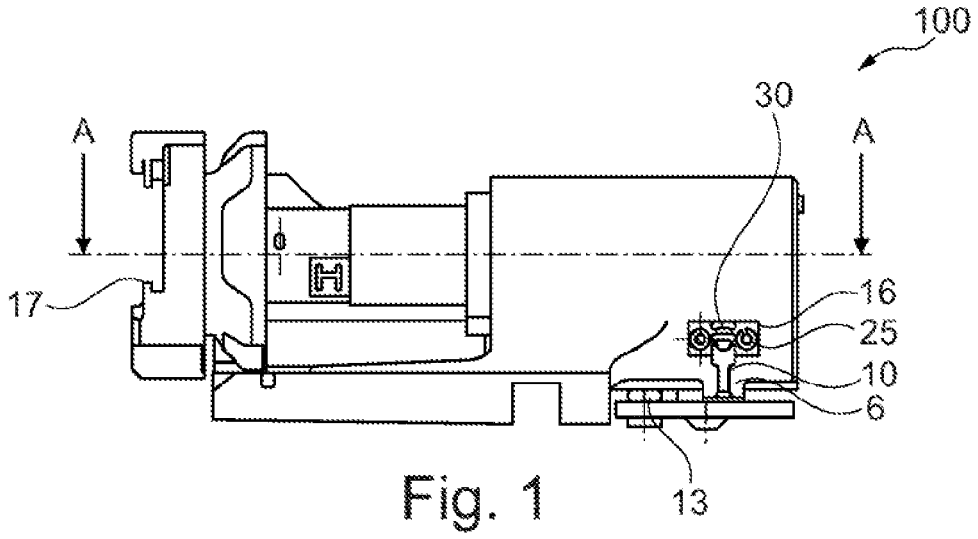
FIG. 1 shows a breech according to the invention in a side representation.
Figure 2:
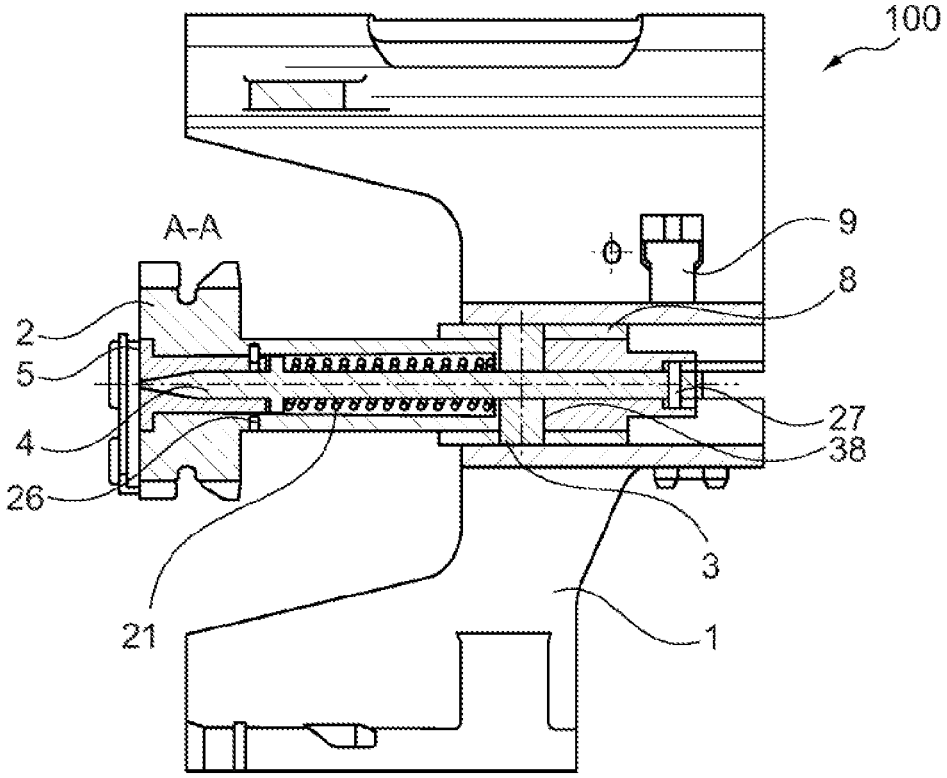
FIG. 2 shows a sectional representation A-A from FIG. 1.

In FIG. 1 and FIG. 2, a breech 100 of a weapon system, not represented in detail, is shown. The breech 100 consists of at least of one breech carrier 1 and one breech head 2. The breech head 2 is carried by the breech carrier 1. A control bolt is marked with 3. This is attached to the breech head 2.

A firing pin 4 can be integrated in the breech head 2. A case 5 is inserted in the breech head 2. This case 5 guides the firing pin 4. At least one dowel pin 26 fixes the case 5 in the breech head 2. At least two dowel pins 26 can preferably be installed.

Figure 5:
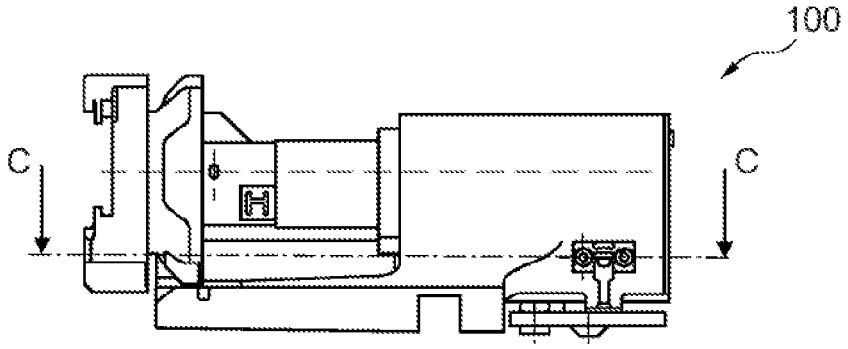
FIG. 5 shows a side representation according to FIG. 3.

A slider is marked with 6, a ring with 7 and a pin with 27. The firing pin 4 can be cocked via the slide 6, the ring 7 and the pin 27 as well as a compression spring 21 when the breech 100 is cocked (FIG. 2, FIG. 5). The slide 6, ring 7, pin 27 and compression spring 21 are integrated in the breech head 2 at the end as seen in the firing direction.

A control case which can be inserted into the breech carrier 1 is marked with 8. The control case 8 has at least one control cam 34 in which the control bolt 3 of the breech head 2 can be guided. This control case 8 holds the breech head 2 via the control bolt 3.

Two control cams 34 are preferred. These control cams 34 are in turn provided on both sides in the control case 8. The control bolt 3 can engage in the two control cams 34. This measure enables a symmetrical arrangement or design. In addition, this construction allows the control bolt 3 of the breech head 2 to be held loosely on the firing pin 4 in a bore 38 leading through to the breech head 2.

Figures 3, 4:
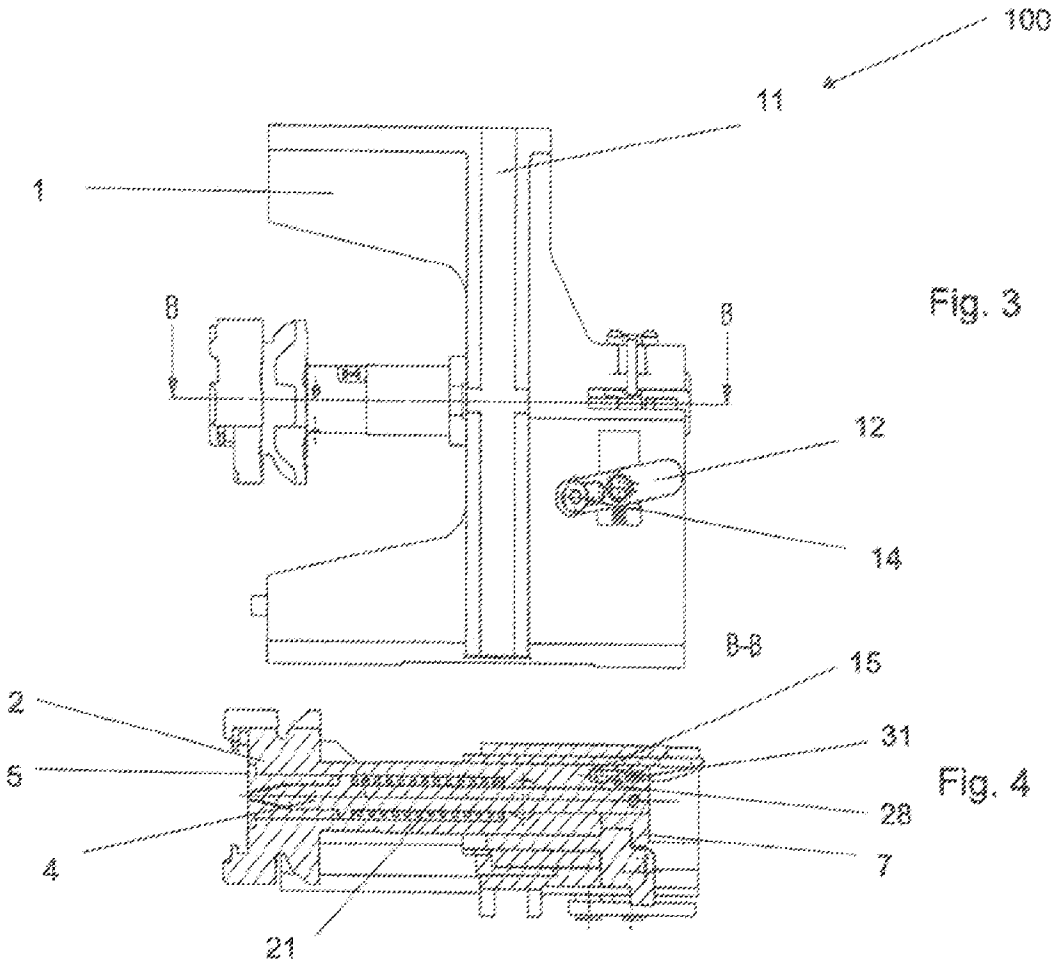
FIG. 3 shows a representation of the breech in a view from below.
FIG. 4 shows a sectional representation B-B of the breech from FIG. 3.

FIG. 3 shows the breech carrier 1 in a representation from below. A release lever 12 can be fastened to the breech carrier 1 below it by means of a washer 13 and a screw 14. The release lever 12 can be mounted displaceably by the washer 13 and the screw 14. This has the advantage that, for example, small manufacturing tolerances of the components involved can be compensated for. The release lever 12 interacts functionally with a first slide 9.

FIG. 4 shows a sectional representation B-B from FIG. 3. A latching pin 15, a dowel pin 28 and a spring 31 are represented here. This spring 31 is preferably designed as a compression spring.

The latching pin 15, the dowel pin 28 and the spring 31 are housed in the ring 7. The dowel pin 28 limits the path of the latching pin 15. The compression spring 31 holds the latching pin 15 in the rest position. A blocking slide 10 (FIG. 1) corresponds to the latching pin 15.

Figure 6:
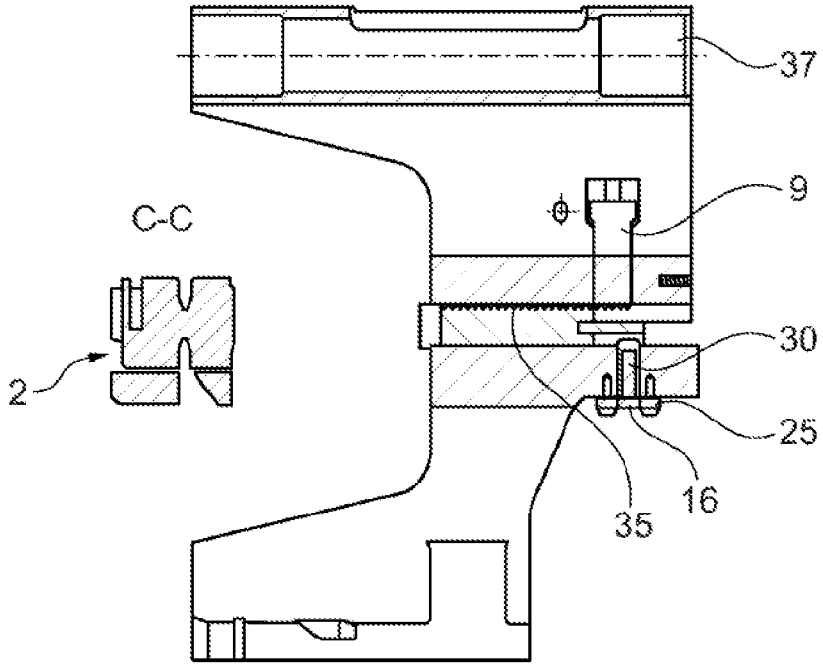
FIG. 6 shows a sectional representation C-C from FIG. 5.
Figure 8:
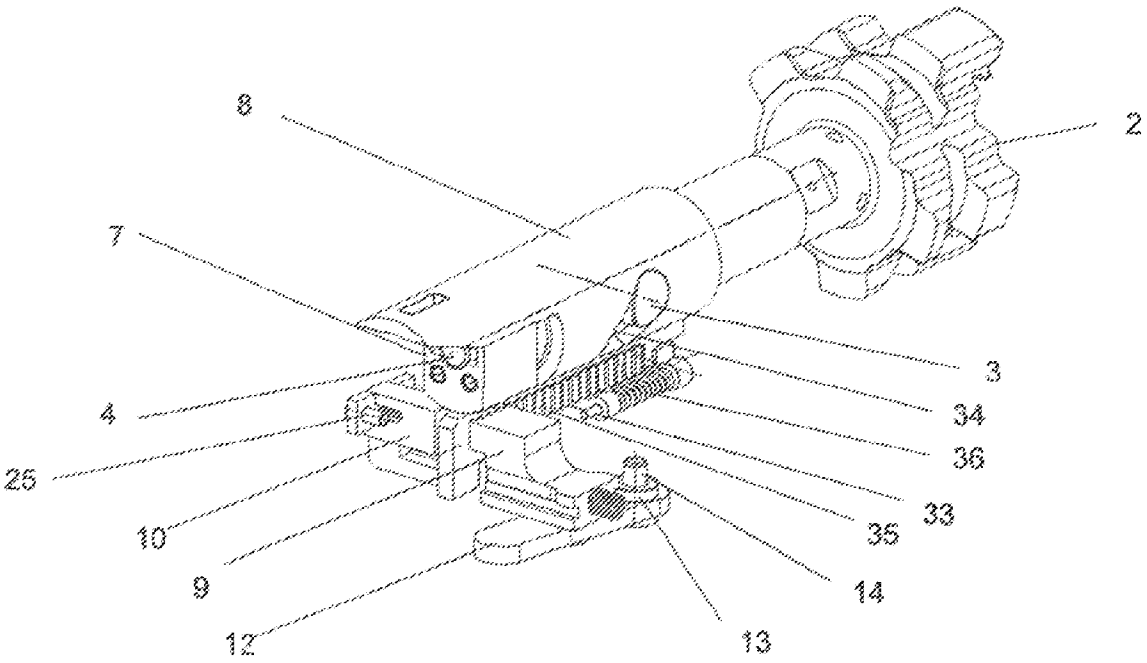
FIG. 8 shows a further perspective representation of the breech without the breech carrier.

FIG. 6 is a sectional representation C-C from FIG. 5. The control case 8 is provided with a detent 35. This is preferably integrated at the side. The first slide 9 can act on or in this detent 35 (FIG. 8). For this purpose, the slide 9 is preferably designed as a latching slide.

Figure 7:
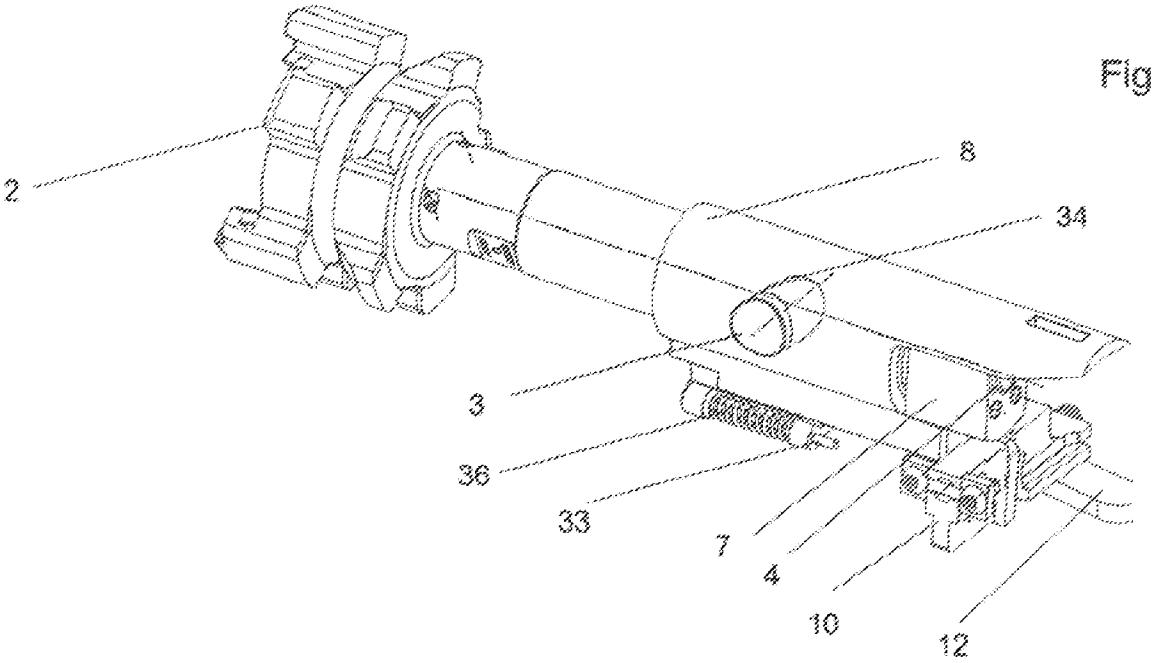
FIG. 7 shows a perspective representation of the breech without the breech carrier.

FIGS. 7 and 8 show the breech 100 without the breech carrier 1 in a lateral perspective representation. A limit stop is marked with 33. This is preferably designed as a spring limit stop with a spring 36 and is supported on the breech carrier 1.

An exemplary operation is as follows:

The breech 100 is brought in the actual weapon function from a firing position to a presentation position and vice versa in a known manner via its breech carrier 1 by a breech drive (not shown in detail), for example an external drive such as a chain drive.

During the downtimes of the breech 100, the drive continues to run within a groove 11 made below the breech carrier 1. The breech 100 is mechanically separated from the drive during its downtimes and is located in the weapon system.

At the time a shot is fired, the breech 100 is locked to a weapon barrel (not shown in more detail), i.e. is mechanically connected to it. As a rule, the weapon barrel has a chamber case. The breech head 2 of the breech 100 is then locked to the chamber case of the weapon barrel.

When the shot has taken place, the breech head 2, the chamber case and the weapon barrel and possibly a recoil suppressor run opposite the breech carrier 1 against the firing direction. The breech carrier 1 and the breech head 2 can be mechanically separated from one another at this point in time. The breech carrier 1 itself is not a component of the returning masses.

When the breech head 2 is returning, i.e. during the recoil and the returning of the returning masses, the slide 9 is ineffective. During return, the slide 9 is controlled.

After reversing the weapon return, i.e. when the returning masses advance, the slide 9 blocks the control case 8 via the detent 35. The breech head 2 with the chamber case or weapon barrel rush further forward. The breech head 2 rotates via the control bolt 3 within the control cam(s) 34. When the locking between the breech 100 or the breech head 2 and the chamber case or the weapon barrel is cancelled, the breech 100 is unlocked from the weapon barrel. The breech head 2 is held in place by the control cam 34 of the control case 8 via the control bolt 3 and is caught in the latter. This creates a mechanical connection between the breech head 2 and the breech carrier 1.

The chamber case and the weapon barrel are brought forward as the returning masses advance until they have reached their starting position. With the advance, a cartridge case is at least partially pulled out of the chamber case or the weapon barrel, which hangs on an extractor 17 on the breech head 2.

The breech carrier 1 and breech head 2 are moved together via a breech drive in the weapon function into a rear position in which a new cartridge is presented to the breech 100.

In order to support the transfer of the breech 100 within the scope of the actual weapon function, the breech carrier 1 provides at least one guide bore 37. This interacts with a guide, not shown in detail, of the weapon or the weapon system.

The release lever 12 runs in the end position on a weapon-side cam during the return or transport of the breech 100 within the scope of the actual weapon function. The release lever 12 actuates the slide 9 and thereby releases the control case 8. In the loading position, the slide 9 is controlled.

The ring 7 and the breech head 2 are then pushed back against the spring 36 of the limit stop 33, i.e. against a resistance, into the front end position thereof in the loading and feeding function of the actual weapon function. This can be done by a buffer, not shown in detail, on the weapon housing.

When the breech 100 advances in the actual weapon function, the slide 10 now blocks the control case 8 and corresponds to the latching pin 15. The possibility of rotating the breech head 2 is blocked by means of the latching pin 15. The blocking slide 10 can be pressed into its rest position by a spring 30 and a blocking plate 16. The blocking plate 16 can be fastened to the breech carrier 1 by means of button-head screws 25, for example.

The cycle begins again with the onset of the weapon return.

The weapon system can fire both targeted single shots and continuous fire.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon system comprising:

a breech, the breech comprising:

at least one breech carrier;

a breech head, wherein the breech carrier supports the breech head, and wherein the breech carrier and the breech head are mechanically separable from one another; and a control case inserted in the breech carrier, the control case having at least one control cam and a control bolt on the breech head, wherein the control bolt engages in the control cam of the control case such that the control bolt is guided in the control cam, wherein the control case is provided with a detent, wherein the weapon system is an externally powered weapon, wherein the detent engages a latching slide that is integrated on a side of the breech carrier, wherein the latching slide blocks the control case in a forward motion of returning masses via the detent, and wherein the latching slide is actuated during an externally powered recoil of the breech.

2. The weapon system according to claim 1, further comprising two control cams introduced into the control case on both sides.

3. The weapon system according to claim 1, wherein the detent is attached to a side of the control case.

4. The weapon system according to claim 1, wherein a release lever is attached below the breech carrier to functionally interact with the latching slide.

5. The weapon system according to claim 1, wherein a firing pin is integrated in the breech head.

6. The weapon system according to claim 5, wherein the firing pin is received by a case inserted in the breech head.

7. The weapon system according to claim 6, wherein at least one dowel pin is provided to fix the case in the breech head.

8. The weapon system according to claim 5, wherein, at an end of the breech head, a cocking slide, a ring, a pin and a spring for cocking the firing pin are integrated.

9. A method for unlocking a breech from a weapon barrel of a weapon system, the method comprising:

providing the weapon system according to claim 1; and unlocking the breech during a forward motion of returning masses.

10. The method according to claim 9, wherein the forward motion of the returning masses is used to release a cartridge case from the weapon barrel.

* * * * *